United States Patent [19]

Hirashiba et al.

[11] Patent Number: 4,597,111

[45] Date of Patent: Jul. 1, 1986

[54] SANITARY DEVICE

[75] Inventors: Yuji Hirashiba; Shinji Kawai, both of Toyota; Tomio Oguma, Anjo, all of Japan

[73] Assignee: Aisin Seiki Kabushiki Kaisha, Japan

[21] Appl. No.: 734,221

[22] Filed: May 15, 1985

[30] Foreign Application Priority Data

May 15, 1984 [JP] Japan .....
May 15, 1984 [JP] Japan ..... 59-71502
May 15, 1984 [JP] Japan ..... 59-71503

[51] Int. Cl.[4] ..... E03D 9/08; A47K 3/20
[52] U.S. Cl. ..... 4/420.4; 4/447
[58] Field of Search ..... 4/420.1–420.4, 4/443–448

[56] References Cited

U.S. PATENT DOCUMENTS 1,887,679 11/1932 Guidetti et al. ..... 4/420.2
1,949,415 3/1934 Guidetti et al. ..... 4/447
1,966,951 7/1934 Guidetti ..... 4/420.5
4,304,016 12/1981 Oguma et al. ..... 4/420.2

FOREIGN PATENT DOCUMENTS 3336461 5/1984 Fed. Rep. of Germany ..... 4/443

*Primary Examiner*—Charles E. Phillips
*Attorney, Agent, or Firm*—Sughrue, Mion, Zinn, Macpeak and Seas

[57] ABSTRACT

A sanitary spray device of the type having a nozzle adapted to extend into a toilet bowl for spraying and washing fluid on the private parts of a person seated on the toilet bowl is provided with a rotatable valve in association with a liquid supply tank. The nozzle is secured to the rotatable valve and is comprised of an outer pipe and an inner concentrically spaced pipe defining inner and outer liquid passages. A spray head is mounted on the end of the nozzle adapted to be disposed in the toilet bowl and is provided with first spray openings adapted to spray liquid on the anal portions of a person and second spray openings adapted to spray liquid on the genital portions of a person. The spray head is provided with a sealing arrangement to communicate the outer fluid passage with the first spray holes and the inner fluid passage with the second spray holes. Upon rotation of the valve the inner and outer liquid passages will be selectively placed in communication with the interior of the liquid supply tank for supplying liquid under pressure to either the first spray holes or the second spray holes.

1 Claim, 4 Drawing Figures

SANITARY DEVICE

BACKGROUND OF THE INVENTION

The present invention is directed to a sanitary spray device adapted to be mounted in a toilet and having a rotatable nozzle means for washing the private portions of a human body and more specifically to a spray nozzle having separate sets of water ejection holes for washing the anal portion and the genital portion respectively through which the water may be selectively ejected.

A sanitary spray device is disclosed in U.S. Pat. No. 4,068,325 wherein the nozzle means is in the form of a single pipe with the interior of the pipe being divided by a longitudinal partition wall into a first flow passage connected to first water ejection hole means and a second flow passage connected to second water ejection hole means. In order to assure fluid tight separation between the first flow passage and the second flow passage the partition wall must be formed integrally with the pipe. However, such a construction is very difficult to achieve in a hollow pipe.

SUMMARY OF THE INVENTION

The present invention is directed to a new and improved sanitary spray device having nozzle means in which a plurality of fluid passages are formed in a simple economical manner.

The present invention is directed to a new and improved sanitary spray device having nozzle means comprised of an inner pipe and an outer pipe coaxially disposed around the inner pipe to provide a first fluid passage between said inner and outer pipes and a second fluid passage within said inner pipe and first and second water ejection hole means disposed in said nozzle means in communication with said first and second fluid passages respectively.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
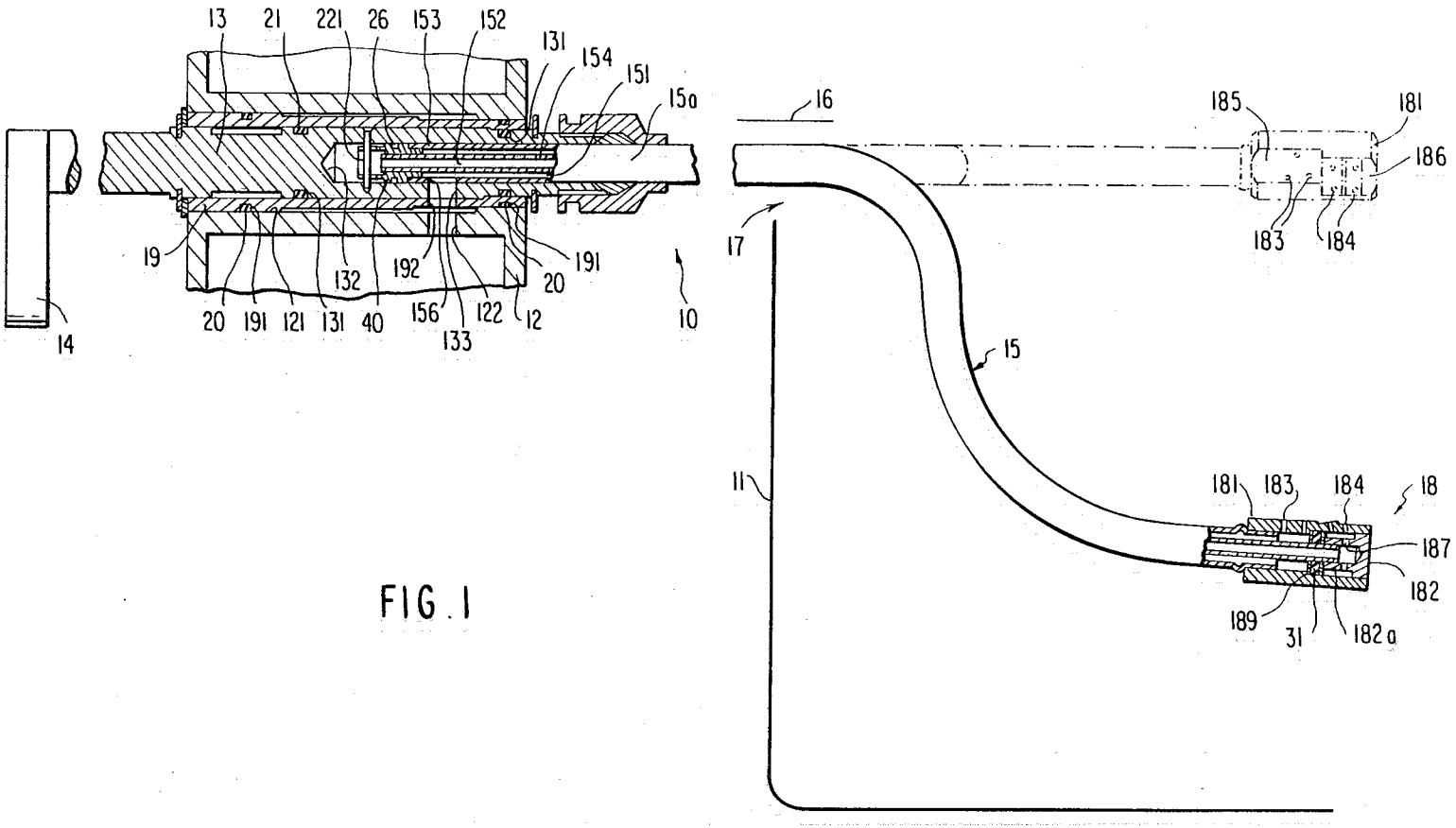
FIG. 1 is a partial sectional view of a sanitary device according to the present invention.

The sanitary spray device 10 is show schematically in association with a toilet bowl 11 upon which a seat 16 having an opening therethrough is mounted for pivotal movement upon the horizontal axis. The valve means 13 according to the present invention is rotatably mounted in a water tank 12 disposed at the left of the toilet bowl 11 as viewed in FIG. 1. The left end portion of the valve means 13 is provided with a lever for operating handle 14 which facilitates the rotation of the valve 13 by a person seated on the toilet seat 16. The right end portion of the valve means 13 is connected with one end portion of a nozzle means 15. The nozzle means 15 extends into the interior space of the toilet bowl 11 through a gap 17 defined between the seat 16 and the upper peripheral edge of the toilet bowl 11. The nozzle means 15 is curved in the conventional manner and is provided with a spray head 18 on the end thereof disposed in the toilet bowl. The nozle means 15 may be rotated from the inoperative raised position to the lower operative position underneath a person seated on the toilet seat 16 by turning the handle 14. While in the lower operative position the valve means 13 and the nozzle means attached thereto may be rotated between two operative positions for spraying water on the anal portion and the genital portion, respectively, of a person seated on the toilet.

The tank 12 contains a quantity of water which is maintained at a predetermined elevated temperature by suitable heating means (not shown). Such preheated water is ejected through the nozzle means upon the introduction of cold water under pressure into the tank which will force the warm water out through the spray head on the end of the nozzle means.

The valve means 13 is rotatably mounted in a sleeve 19 which in turn is fitted into a cylindrical portion 121 in the upper portion of the tank 12. A fluid tight seal is provided between the sleeve 19 and the cylindrical portion 121 of the tank 12 by means of a pair of O-rings 20 which are fitted into a pair of longitudinally spaced annular grooves 191 formed in the outer circumference of the sleeve 19. A similar fluid tight connection is provided between the rotatable valve means 13 and the sleeve 19 by means of a pair of O-rings 21 fitted in a pair of longitudinally spaced annular grooves 131 in the outer circumference of the valve means 13.

The cylindrical portion 121 of the tank 12 is provided with a radially directed aperture 122. The sleeve 119 is provided with a radial aperture 192 disposed in alignment with the aperture 122. The aligned apertures 122 and 192 are located intermediate the spaced apart pairs of sealing rings.

Figure 2:
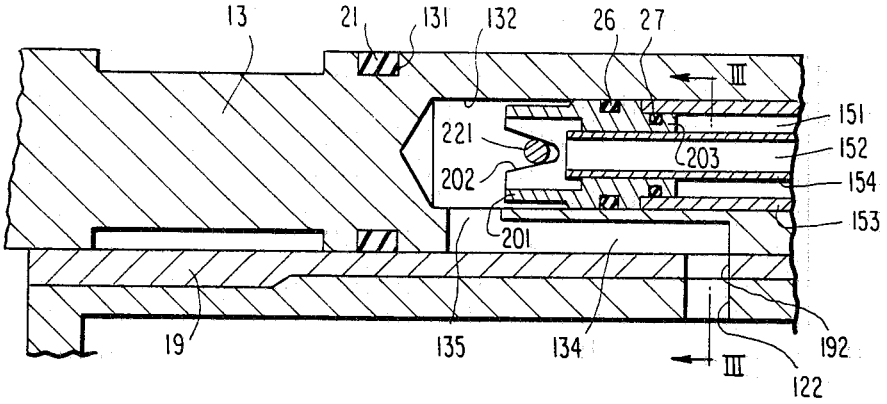
FIG. 2 is a detailed sectional view of the valve means shown in FIG. 1.
Figure 3:
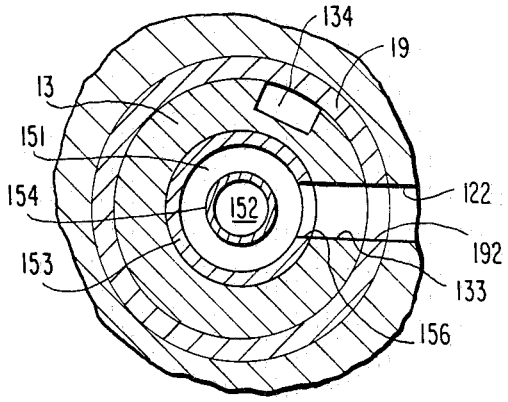
FIG. 3 is a cross sectional view taken substantially along the line III—III in FIG. 2 with the valve member rotatably displaced from the position shown in FIG. 2.

The valve means 13 is provided with a blind bore 132 in which a base portion of the nozzle means 15 is inserted so as to be rotated together with the valve means 13 upon manipulation of the handle 14. The nozzle means 15 is comprised of an outer pipe 153 and an inner pipe 154 concentrically spaced therefrom by means of a support member 40 disposed within the blind bore 132 of the valve means 13. The support member 40 is provided with an axially extending cylindrical projection 203 which is fitted within the end portion of the outer pipe 153 of the nozzle means 15 and the end portion of the inner pipe 154 is fitted within a bore extending axially of the support member 40. A sealing ring 26 is provided between the support member 40 and the blind bore 132 while a sealing ring 27 is provided between the cylindrical projection 203 on the support member 40 and the outer pipe 153. Thus the inner pipe 154 is concentrically spaced from the outer pipe 153 to define a first fluid passage 151 therebetween and a second fluid passage 152 within the inner pipe 154. The support member 40 is provided with a cylindrical flange portion 201 extending in the opposite direction from the cylindrical projection 203. A pair of radially opposed notches 202 (only one of which is shown in FIG. 2) are provided in the cylindrical flange portion 201 and are disposed in engagement with a diametrically extending pin 221 which extends transversely of the blind bore 132. Thus upon rotation of the valve means 13 by the handle 14 the nozzle means 15 will also be rotated due to the connection defined by the pin 221 and the notches 202.

The valve member 213 is provided with a radially extending aperture 133 which is disposed in alignment with a radially extending aperture 156 in the outer pipe 153. When the apertures 122, 192, 133 and 156 are all disposed in alignment upon rotation of the valve means 13 to a first operating position the interior of the water tank 12 will be disposed in communication with the first fluid passage 151.

A longitudinally extending slot 134 is formed in the outer surface of valve means 13 and is circumferentially spaced from the aperture 133. One end of the slot 134 communicates with the innermost of the blind bore 132 through an aperture 135 as best seen in FIG. 2 while the opposite end of the slot 134 is adapted to be disposed in alignment with the apertures 122 and 192 upon rotation of a valve member 13 to a second operating position. With the valve means 13 in the second operating position the interior of the water tank 12 will be disposed in communication with the second fluid passage 52.

A spray head 18 is fixedly mounted on the opposite end of the nozzle means 15 and is comprised of a main body 181 having an axially extending stepped bore 188 extending therethrough. A pair of differently angled plane portions 185, 186 are formed on the outer circumference of the main body 181. The plane portions are angularly offset from each other with the plane surface 186 being disposed immediately adjacent the free end of the body 181. A first plurality of water ejection holes 183 extend through the body 181 from the bore 188 through the plane surface 185 and a second plurality of water ejection holes extend through the body 181 from the bore 188 through the plane surface 186. A plug 182 having a cylindrical boss **182*a* is threaded in the outermost end of the bore 188**.

Figure 4:
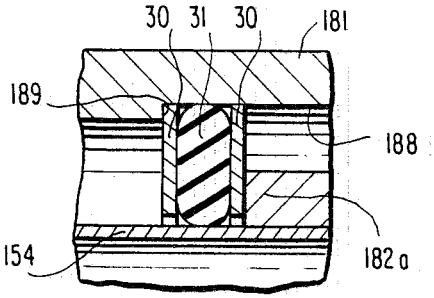
FIG. 4 is an enlarged detailed sectional view of the sealing arrangement in the nozzle head of FIG. 1.

The end portion of the outer pipe 153 is fixedly secured within the smaller diameter portion of the bore 188 and the end portion of the inner pipe 154 is fixedly secured in a blind bore located within the cylindrical boss **182*a* of the plug 182. Thus the first fluid passage 151 is disposed in communication with the holes 183 and the second fluid passage 152 is disposed in fluid communication with the holes 184 through radial holes 187 formed in the cylindrical boss 182*a* of the plug 182. The holes 183 and 184 are separated from each other in a fluid tight manner by means of an O-ring 31. The O-ring 31, which is shown in detail in FIG. 4, is disposed in engagement with the larger diameter portion of the stepped bore 188 and the outer surface of the inner pipe 154. The O-ring 31 is disposed between a pair of washers 30 which surround the end of the inner pipe 154 and are disposed in engagement with the inner circumference of the larger diameter portion of the stepped bore 188. One of the washers 30 is disposed in engagement with the stepped portion 189 of the stepped bore 188 and the other washer 30 is disposed in engagement with the axial end of the cylindrical boss 182*a*. Thus, upon threading the plug 182 into the spray head body 181, the O-ring 31 will be squeezed between the washers 30 and expanded radially inwardly and radially outwardly into tight sealing engagement with the inner pipe 154 and the inner surface of the bore 188**, respectively.

In summary the valve means 13 may be rotated by the handle 14 to either a first operative position wherein water will be supplied through the first fluid passage 151 to the spray holes 183 or to a second operative position where water will be supplied through the second fluid passage 152 to the spray holes 184. The spray holes 183 are designed to spray water on the anal portion of a person seated on the toilet while the spray holes 184 are adapted to spray water on the genital portion of a person seated on the toilet.

While the invention has been particularly shown and described with reference to a preferred embodiment thereof it will be understood by those in the art that various changes in form and details may be made therein without departing from the spirit and scope of the invention.

What is claimed is:

1. A sanitary device comprising tank means adapted to contain a supply of fluid and adapted to be located adjacent a toilet bowl, valve means rotatably supported on said tank means in fluid communication with said tank means, nozzle means secured to said valve means for rotation therewith and adapted to extend into said toilet bowl, said nozzle means comprising an inner pipe and an outer pipe disposed in concentric spaced apart relation and having means defining a first fluid passage between said pipes and a second fluid passage within said inner pipe, fluid passage means formed in said tank and first and second aperture means formed in said valve means whereby upon rotation of said valve means to a first position said first fluid passage will be disposed in fluid communication with said tank means through said fluid passage means and said first aperture means and upon rotation of said valve means to a second operating position said second fluid passage will be disposed in fluid communication with said tank means through said fluid passage means and said second aperture means and spray head means secured to the end of said nozzle means adapted to be located in said toilet bowl and having first fluid ejection hole means disposed in fluid communication with said first fluid passage and second fluid ejection hole means disposed in fluid communication with said second fluid passage for selectively spraying fluid on different portions of a person seated on said toilet bowl, said spray head means includes a substantially cylindrical main body having an axially extending stepped bore therein with the smaller diameter portion of said stepped bore being secured to said outer pipe, plug means threaded into the larger diameter portion of said stepped bore and having an apertured annular boss extending axially inwardly toward said smaller diameter portion, sealing means disposed intermediate said larger and smaller diameter portions of said bore in contact with said annular boss with said inner pipe extending through said sealing means into said annular boss whereby said first fluid passage and said first hole means will be separated from said second fluid passage and said second hole means in a fluid tight manner.

* * * * *